US006807790B2

(12) United States Patent
Strickland et al.

(10) Patent No.: US 6,807,790 B2
(45) Date of Patent: Oct. 26, 2004

(54) RING BEAM/LINTEL SYSTEM

(75) Inventors: Mike Strickland, Richmond Hill (CA); George Hage-Chahine, Ville Mont-Royal (CA); Sam Blatchford, Boucherville (CA); Gord McIntyre, Mississauga (CA); Mike Gallant, Oakville (CA)

(73) Assignee: Canam-Manac Group, Boucherville (CA)

( * ) Notice: Subject to any disclaimer, the term of this patent is extended or adjusted under 35 U.S.C. 154(b) by 0 days.

(21) Appl. No.: 10/263,763

(22) Filed: Oct. 4, 2002

(65) Prior Publication Data

US 2003/0084629 A1 May 8, 2003

(30) Foreign Application Priority Data

Oct. 9, 2001 (CA) ..... 2358747

(51) Int. Cl.[7] ..... E04C 3/30
(52) U.S. Cl. ..... 52/731.2; 52/250; 52/252
(58) Field of Search ..... 52/289, 702, 731.2, 52/732.1, 82, 248, 246, 698, 92.1, 92.2, 93.1, 251, 262, 259

(56) References Cited

U.S. PATENT DOCUMENTS 1,720,104 A * 7/1929 Taylor et al. ..... 403/232.1
3,784,151 A * 1/1974 Steele ..... 249/18
4,126,976 A * 11/1978 Crowley ..... 52/223.3
4,333,285 A * 6/1982 Koizumi et al. ..... 52/252
4,409,764 A * 10/1983 Wilnau ..... 52/127.3
4,423,977 A * 1/1984 Gilb ..... 403/232.1
5,050,358 A * 9/1991 Vladislavic ..... 52/334
5,433,501 A * 7/1995 Thomas et al. ..... 296/191
5,564,248 A * 10/1996 Callies ..... 52/702
5,970,678 A * 10/1999 Pellock et al. ..... 52/730.4
6,253,524 B1 * 7/2001 Hopton et al. ..... 52/731.2
6,519,908 B1 * 2/2003 Masterson et al. ..... 52/696
6,523,321 B1 * 2/2003 Leek et al. ..... 52/702
6,584,741 B1 * 7/2003 Hatzinikolas ..... 52/289
6,625,943 B1 * 9/2003 Renner ..... 52/251

* cited by examiner

*Primary Examiner*—Carl D. Friedman
*Assistant Examiner*—Nahid Amiri
(74) *Attorney, Agent, or Firm*—Shapiro Cohen

(57) ABSTRACT

The present invention allows the planner of a multi-storey building project to remove concrete from the critical path of the structure and envelope completion. The system of the present invention accommodates various floor depths, conforms to alternative stud depths and, acts as a compression/tension member for a building during and after construction. The invention relies upon the use of cold-formed metal that is shaped to provide a ring beam which will accommodate the various criteria. A basic shape configuration has been generated to provide the most efficient utilization of materials. Simplifying installation for the many variable conditions that occur in buildings is therefore provided by this modular design, wherein designers and contractors can easily select and use specialized components to meet all design and construction requirements.

5 Claims, 10 Drawing Sheets

RING BEAM/LINTEL SYSTEM

FIELD OF THE INVENTION

The present invention relates to the field of commercial building construction, and in particular to buildings with concrete floors supported on steel joists, and preferably where the floors are composite steel and concrete structures.

BACKGROUND OF THE INVENTION

When using steel supported concrete floors in a building, the conventional practice is to erect the steel joists on support walls and to pour each concrete floor once the steel joists and floor pan have been placed. Further vertical walls for the next story of the building are then erected, and joists are supported on the walls. The construction proceeds one floor at a time with a separate concrete pour occurring for each floor, requiring numerous returns of the concrete pouring crew during construction. Further the labor used to erect walls is not required when the concrete is being set in place.

It would be highly desirable to be able to form up the entire building in an uninterrupted manner at one time and pour the concrete floors following the erection of the structure in an independent manner The alternate work of framing and concreting crews would be avoided, and significant cost savings in the construction would be achieved. In order to achieve this significant improvement, it has been found that changes are required in both the structural design of the building, and that these changes improve both the speed and convenience of construction, and the structural strength of the building both before and after the pouring of the concrete floors.

In civil engineering ring beams are used as continuous tension members surrounding the perimeter domes, hemispheres, and like structures which carry compression forces from loads supported by them and tension forces caused by the load seeking to spread the ring. The ring beam is designed to resist both forces. Ring beams need not be circular, but may be conformed to the shape of the structure in which it is incorporated. It is a compression/tension member to resist these forces in the structure.

For the use of structural members commonly known as joists, in conjunction with metal stud, wood stud or prefabricated wall panels, it is necessary to provide an effective means to distribute the resulting dead and live point loads resulting from these members. For the fastest speed of construction, it is of particular importance to have a joist-support-system that will spread loads along the wall concentrically, while at the same time allowing the erection of multiple floors without the need to have concrete in place. Presently the construction industry does not have an efficient system to enable the facilitation of all of the above criteria, via a pre-designed integrated-modular-component-system. In today's construction industry, it is overly complicated to satisfy all of the above criteria, and requires the use of many project-specific details.

STATEMENT OF THE INVENTION

The present invention has been developed to provide a modular approach to satisfy all of the above criteria. The system allows the planner of a multi-storey building project to remove concrete from the critical path of the structure and envelope completion. The system of the present invention accommodates various floor depths, conforms to alternative stud depths and, acts as a compression/tension member for a building during and after construction. The invention relies upon the use of cold-formed metal that is shaped to provide a ring beam which will accommodate the various criteria. Notably, the system spreads the concentrated load to many adjacent studs to limit the direct load on one stud along the load bearing wall. After 2 or 3 levels in a multi-storey project are formed, the concentrated loads are uniformly distributed over all the stud walls.

The ring beam structure is formed of a hat section that is positioned with the open side facing in, atop each level of the perimeter wall of the building at each floor location, which is supported by the wall, and provides a seat supporting the floor joists, and in turn supports the next level of the perimeter wall. Stabilizer struts are positioned at required intervals to stabilize the ring beam section during erection of the building frame and prior to concreting. In addition to serving as a structural member in the building frame the ring beam also acts as a passive pour stop to prevent the escape of concrete when floors are being poured. The ring beam also provides a continuous tension/compression ring at the perimeter of the floor system when tension/compression struts are installed at the splices of the ring beam. The basic shapes developed for supporting joists before and after concreting are a ring beam formed of a hat section with variable dimensioning capability, a stabilizer strut which can be fastened to the flanges of the hat section, and tension/compression struts which are similarly fastened to the flanges of adjacent hat sections, as will be detailed below.

BRIEF DESCRIPTION OF THE DRAWINGS

The features of the invention will be apparent from a consideration of the following description in conjunction with the following drawings in which.

DETAILED DESCRIPTION OF THE INVENTION

Figure 1:
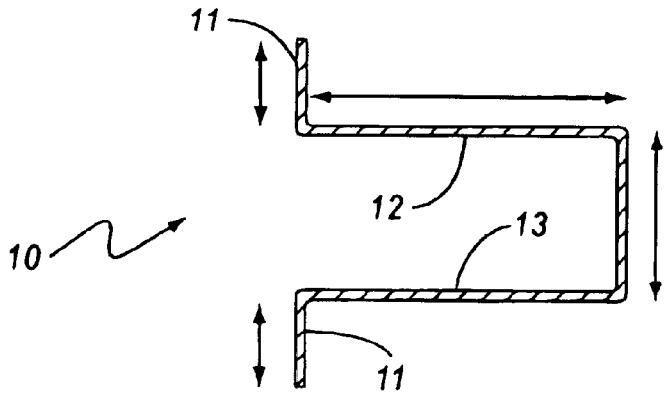
FIG. 1 is a cross section of a hat section for use as a ring beam of the invention.

Referring to FIG. 1, ring beam for a building is formed of a hat section of sheet steel 10 shown in section, the beam being of indefinite length, and may be joined to like members to form a hollow three sided ring beam channel with vertical flanges 11 above and below the channel portion 12. The depth of the channel portion 12 is selected to match the thickness of the walls of the building in which the ring beam is imbedded. It will be appreciated that the hat section 10 being formed from cold rolled sheet steel, that it is relatively easy to adjust the size of the channel portion to match both the depth of the wall, as the fabrication is entirely a matter of metal bending, or rolling requiring little in the way of machinery, and consequent capital expense.

The hat section ring beam may be conveniently fastened to the wall studs above and below the ring beam by self tapping sheet metal screws or hardened nails driven through the vertical flanges and/or through the channel portion of the beam. The channel portion 12 has a lower face 13 which provides a bearing surface for floor joists which may be inserted in the ring beam during building construction. A significant improvement in construction is achieved by connecting the wall studs to the vertical flanges of the ring beam, eliminating the C-section channel normally used for connection to the top and bottom of the vertical joists. Holes may be punched in the vertical flanges at appropriate intervals to space the vertical joists to the required spacing dependant on building strength requirements.

Figure 2:
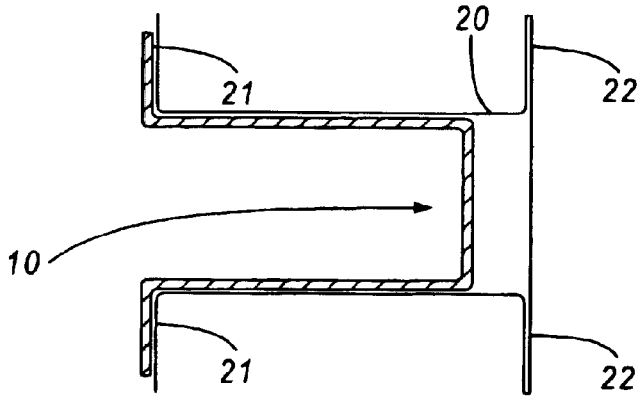
FIG. 2 is a cross section of a two-part modified hat section having increased load capacity.

FIG. 2 illustrates a two part hat section having increased strength for load bearing. As before a hat section 10 is provided, which is nested within a second hat section 20. The second or outer hat section 20 is provided with flanges 21 and 22, and may be assembled with the hat section 10 either before or after the second hat section 20 is secured to the upper and lower walls.

Figure 3:
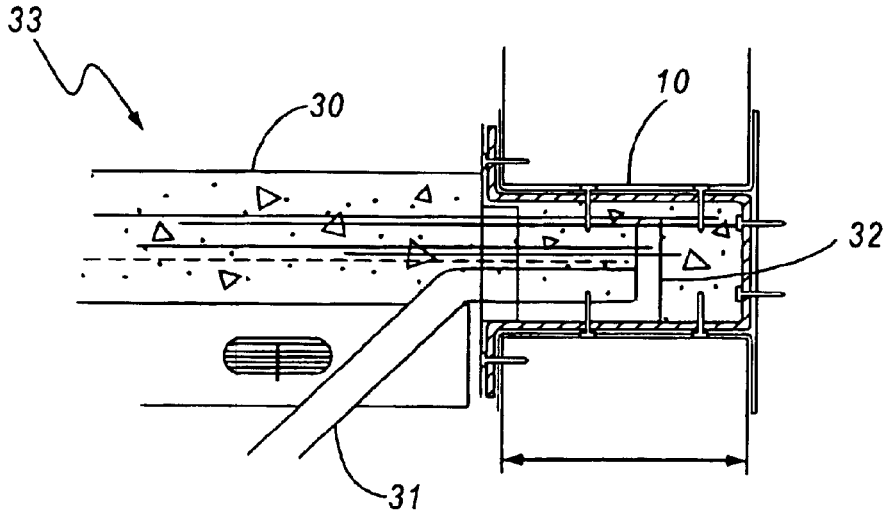
FIG. 3 is a section through a hat section ring beam illustrating its function as a passive pour stop.

FIG. 3 illustrates an open web joist 33 having a top chord 30, a bar type web 31 and an end shoe 32 seated in a ring beam 10. The joist 33 as illustrated is shown as Hambro type joist having a top chord which also acts as a shear connector with a subsequently poured concrete floor. Other types of steel joist may also be used with the ring beam 10, with appropriate dimensional adjustments.

Figure 4:
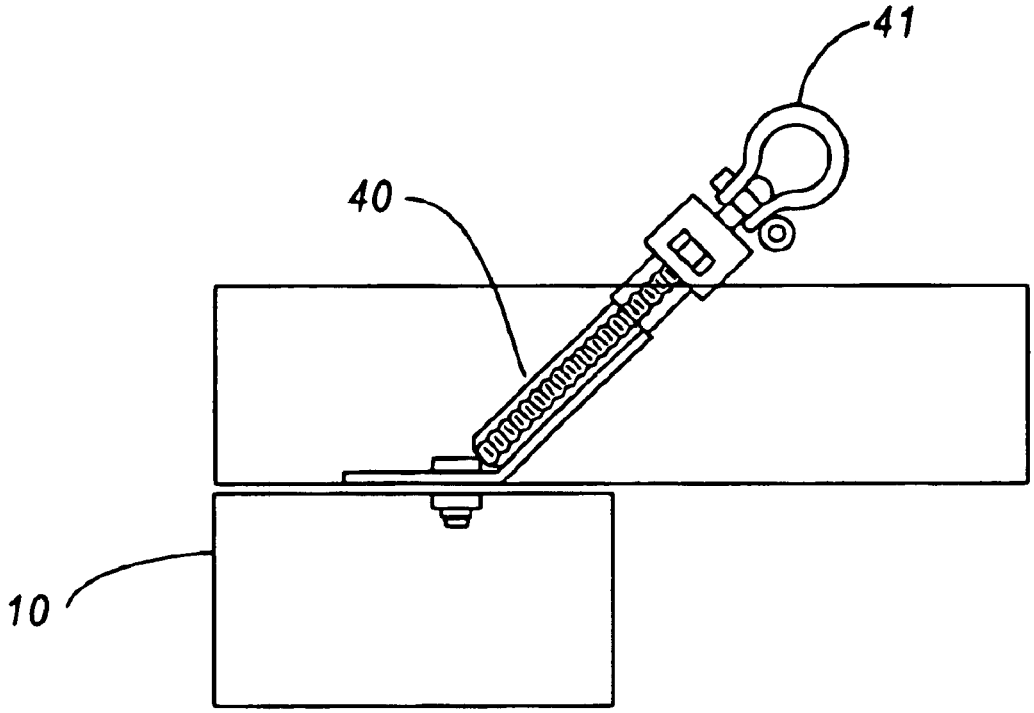
FIG. 4 shows a stay-in-place anchor fastened to the ring beam.
Figure 5:
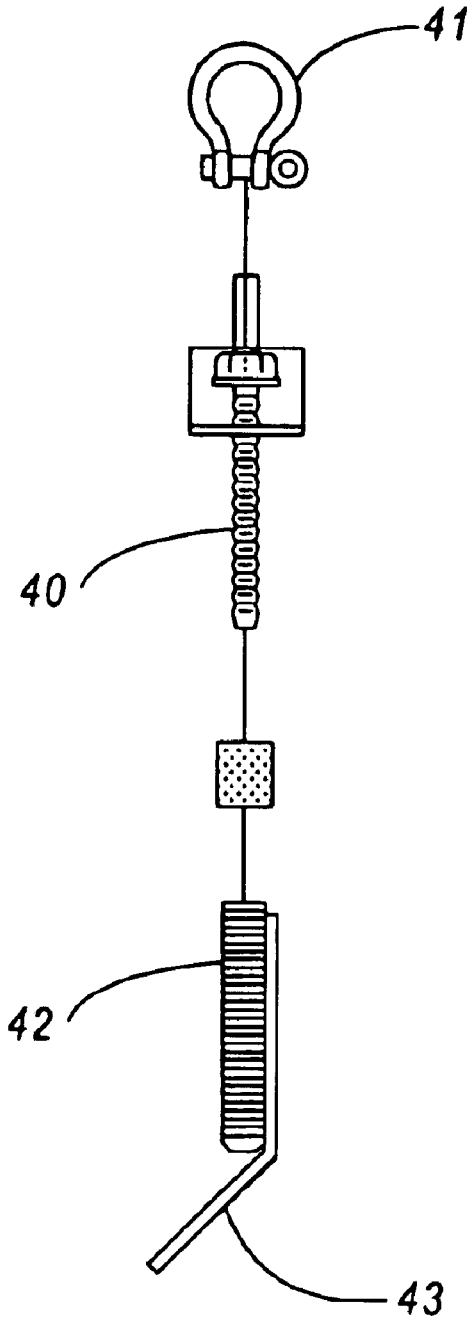
FIG. 5 is an exploded view of the anchor of FIG. 4.

FIG. 4 illustrates one form of anchor for connecting diagonal bracing in a building under construction. The brace is bolted to the ring beam 10, and has a threaded section 40 for tensioning a cable connected to the clevis 41. These components are shown in an exploded view in FIG. 5. A threaded sleeve 42 mates with a bolt 40 and is fastened to an angle 43. These components are assembled and provide an anchor for bracing the building under construction.

Figure 6:
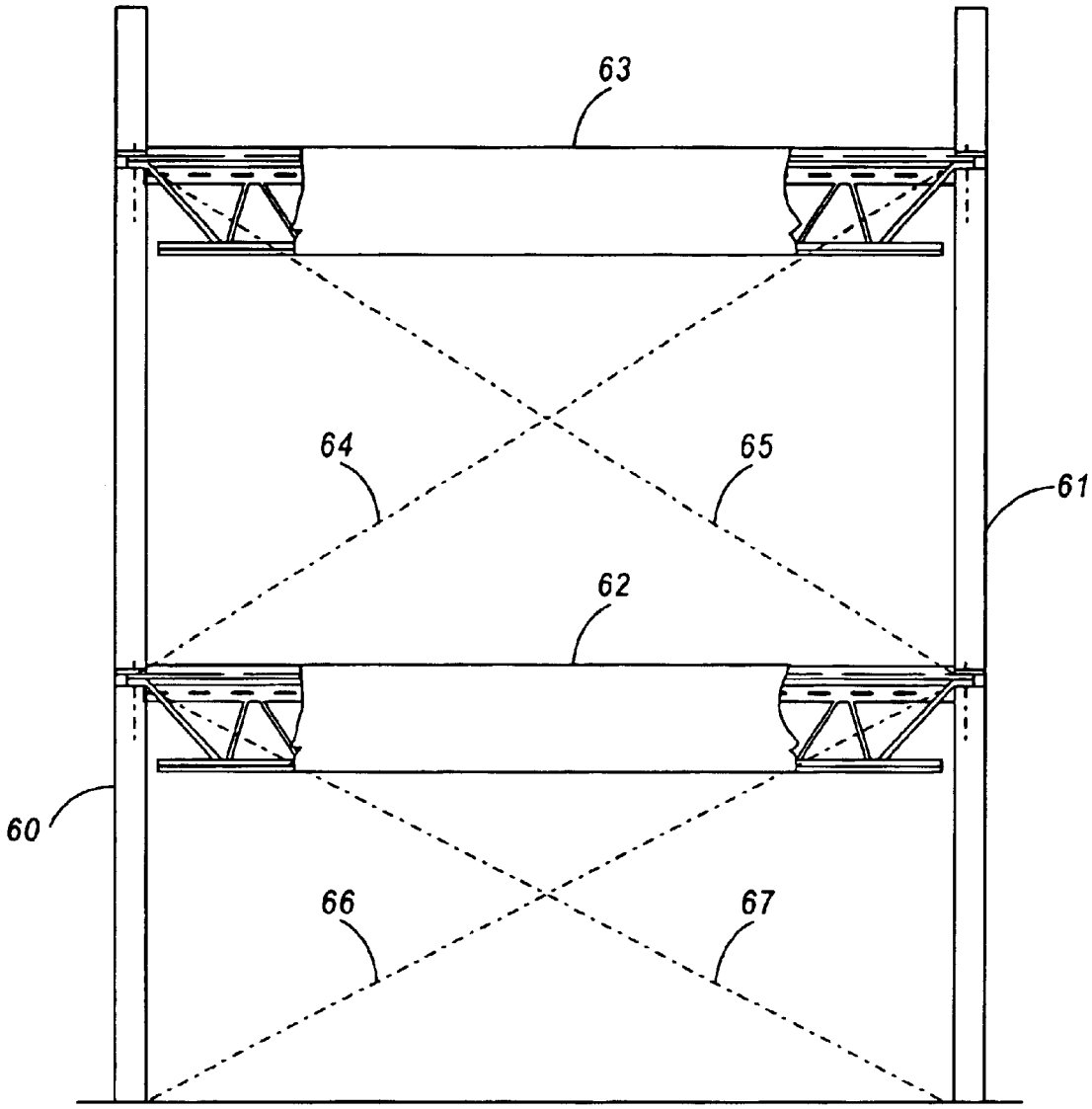
FIG. 6 is a vertical section of a building under construction.

FIG. 6 shows in section a multi-story building having walls 60 and 61 and joists 62 and 63. The structure being braced by cables 64, 65, 66, and 67.

Figure 7A:
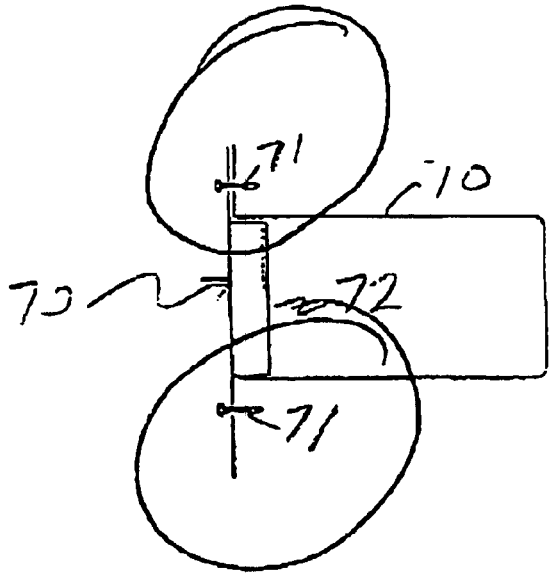
FIG. 7A is a section of a ring beam showing a stabilizer strut fastened thereto.
Figure 7B:
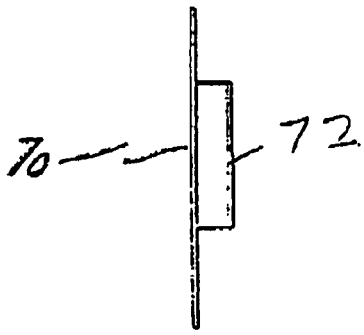
FIG. 7B is a side view of the strut of FIG. 7A.
Figure 7C:
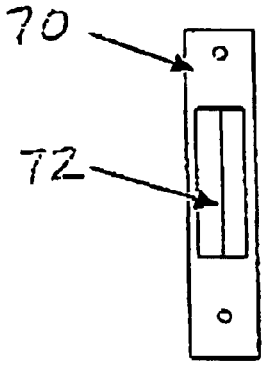
FIG. 7C is a front view of the strut of FIG. 7A.

FIGS. 7A, 7B, and 7C illustrates a stabilizer strut 70, which in FIG. 7A, is shown fastened to a ring beam 10, by self tapping screws 71. In FIG. 7B, a side view is shown, where a stiffener 72 is fastened to or formed from the body of the stabilizer strut 70. The stabilizer strut 70 is shown front view in FIG. 7C, with the stiffener 72 facing the viewer. Typically the stiffener 72 is fastened to the stabilizer strut 70 by welding or the like, however other techniques that provide a vertical column strength to the stabilizer are also contemplated. Such stabilizer struts are positioned at intervals all along the hat section of the ring beam. In some cases it may be advantageous to align the position of the stabilizer strut with the studs in walls above and below the ring beam. Alternatively, the struts may be placed to impart adequate load bearing capacity to the ring beam for all construction loads. Once the concrete floors have been poured, the ring beam filled with concrete will have adequate compressive strength. If required, shear connections for the ring beam and concrete can be provided by fastening devices such as Nelson studs to a surface of the channel portion of the ring beam hat-section.

Figure 8:
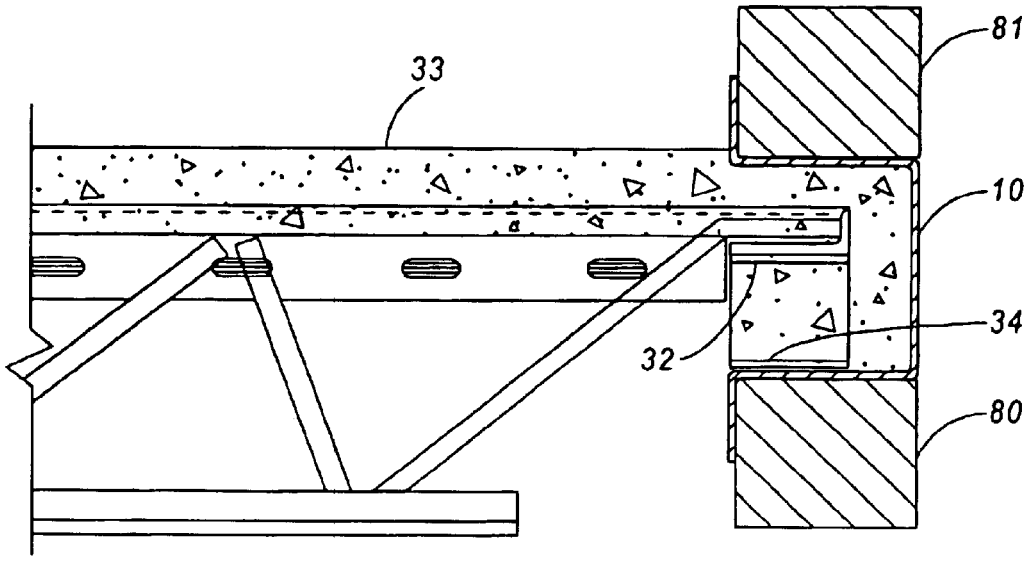
FIG. 8 is a section of a concrete floor.

FIG. 8 illustrates a section through a building at a lintel. A joist seat extension 34 is positioned beneath the end shoe of a joist supported over the lintel thereby providing extra depth to the ring beam at the lintel. Wall portions 80 and 81 support the hat section 10 which hat section is of increased depth to form the lintel.

Figure 9:
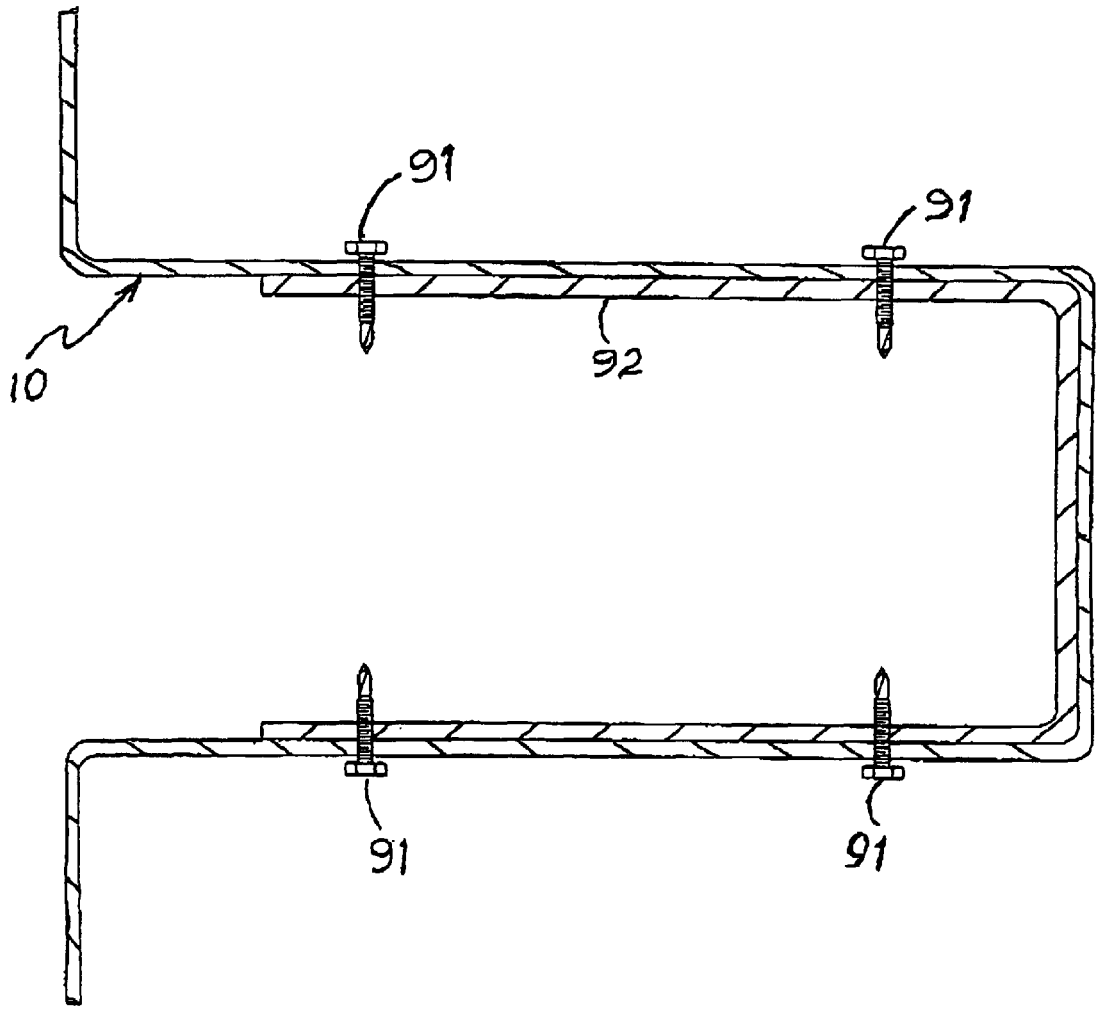
FIG. 9 is a section of a tension/compression strut used for joining hat sections.

FIG. 9 shows in section a channel shaped tension/compression strut 92 which is installed with self-tapping screws 91 at splices of the hat section 10 thereby providing a tension/compression ring at the perimeter of the floor. A corner connector tension/compression strut (not shown), having the same cross-section as the tension/compression strut 92 of FIG. 9, but formed as a right angle in plan, would be used at each corner of each floor of the building, providing structural integrity to the ring beam.

Figure 10:
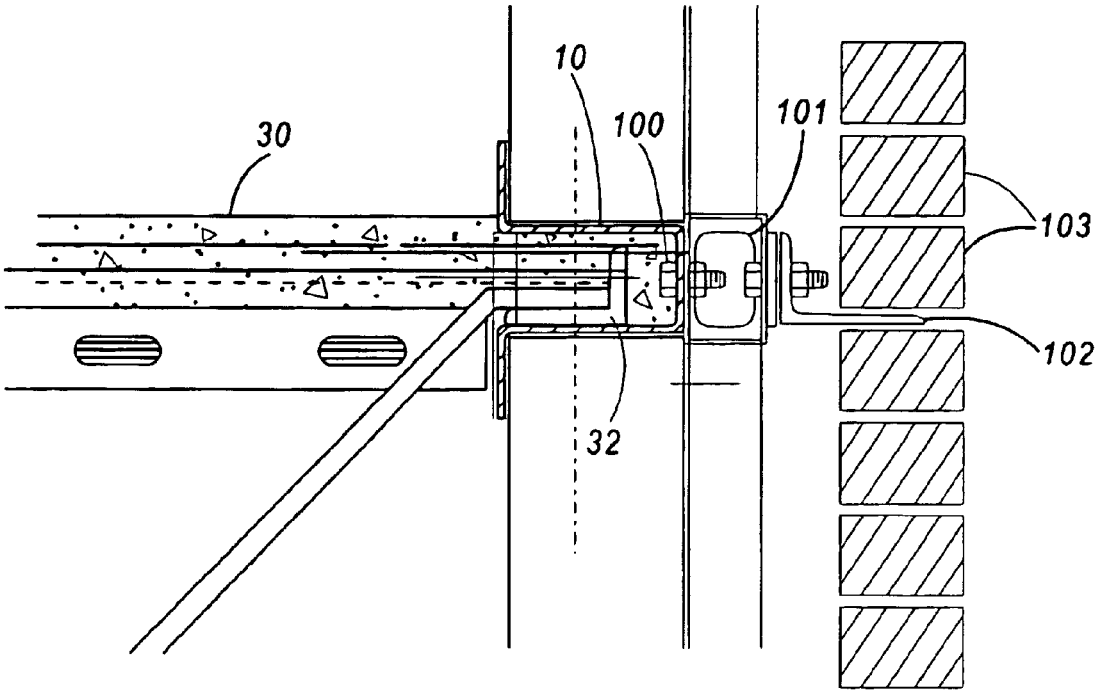
FIG. 10 is a further building section.

FIG. 10 shows a system of construction which includes support shelves 102 for supporting a brick exterior on the walls of the building. For this purpose, pre-punched holes may be provided in the vertical base of the channel 12. A support shelf can thus be provided at each floor of the building.

Figure 11:
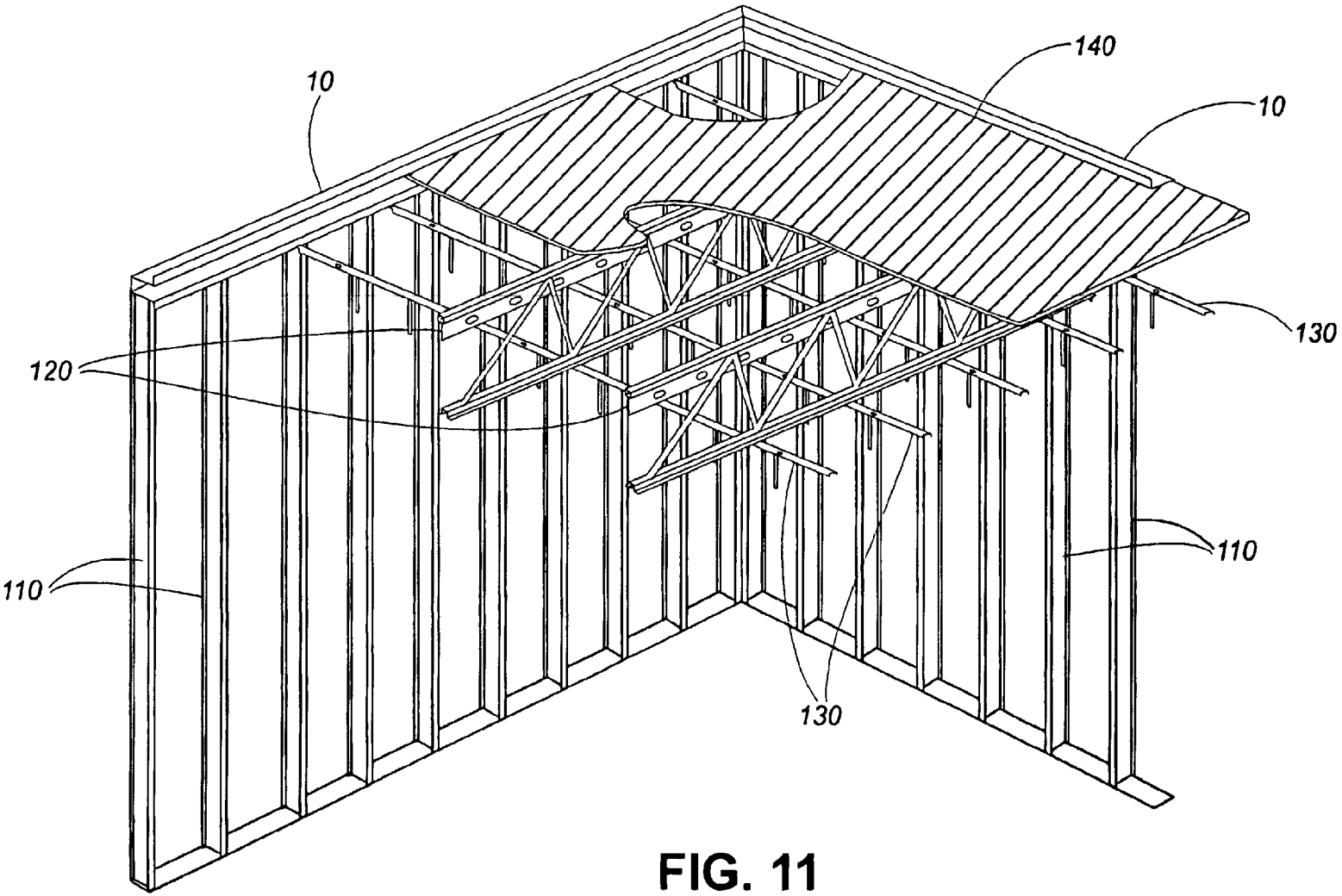
FIG. 11 is a perspective view of a partially completed building illustrating the wall studs, the ring beam, the floor joists and the floor pan for a corner of the building.

FIG. 11 is an isometric view of a corner of a building in accordance with the invention. A plurality of vertical studs 110 are positioned in the exterior wall of a building under construction. Mounted on top of the studs is a ring beam 10 supporting a series of "Hambro" open web steel joists 120. Spanner bars 130 are interconnected with the joists 120 in the usual way, and removable decking 140 is supported by the spanner bars 130. All of these elements are secured by appropriate cables braces as shown in FIG. 6. Successive layers of wall surmounted by ring beams are constructed until the building is entirely framed. Subsequently, the concrete floors of the building are poured, with the ring beam of each floor used as the edge of the form-work, and the decking supporting the concrete in accordance with normal practice. Thus the different tradesmen for the different phases of the building may complete their portions of the building without awaiting the intermittent pauses while each performs only a segment of the work on the building. By deferring the concreting until completion of the frame, savings in cost are obtained and delays in construction are avoided.

A building constructed in accordance with the present invention will have superior strength to resist earthquake loads due to the presence of the ring beam around each floor of the building, which is integral with the concrete floors, thus assisting transfer of horizontal loads to the building foundations.

Figure 12:
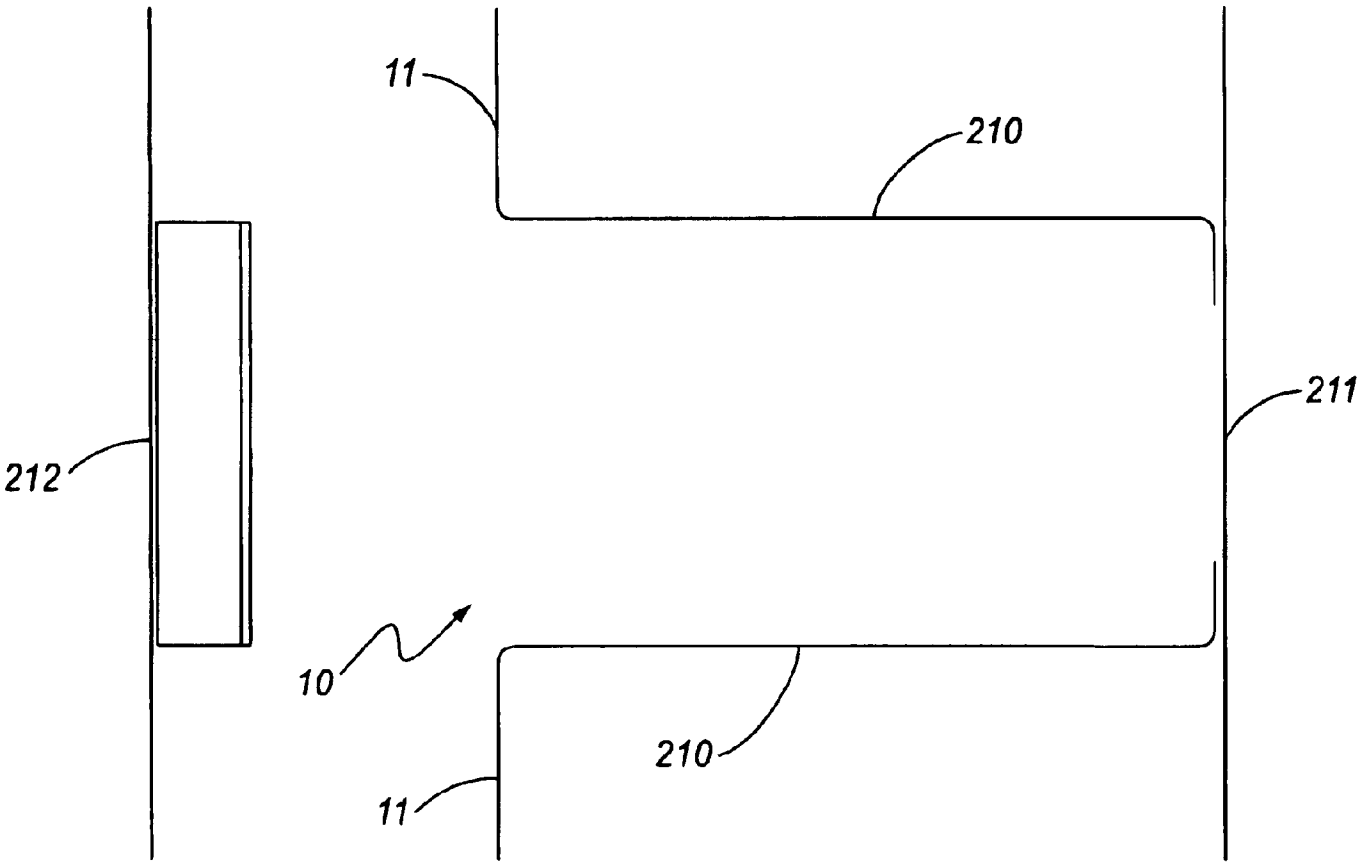
FIG. 12 is an alternative construction of the ring beam and stabilizer using bent shape components.

FIG. 12 illustrates in section an alternative means for fabricating the ring beam using flat strips of sheet steel, and bending the upper and lower Z-section shapes 210 to form the upper and lower sides of the hat section, and fastening them to the base sheet 211 by screws (not shown), welding or the like. The vertical flanges vertical flanges 11 are used as before for connection to the wall joists, and the stabilizer strut 212 is also connected to the flanges 11 as before, thus the ring beam may be fabricated using only metal shearing and bending equipment which is readily available in the construction material manufacturing industry. Only two metal bending operations are required to form the identical pieces 210, and assembly of the components 210 and 211 can be done with simple jigs to align the components.

Punching of holes for stud connection to the flanges 11 can also be done before bending or after.

A person understanding the above-described invention may now conceive of alternative designs, using the principles described herein. All such designs which fall within the scope of the claims appended hereto are considered to be part of the present invention.

What is claimed is:

1. A horizontal ring beam for incorporation into the exterior walls of a steel and concrete composite building in which steel joists support concrete floors of said building, said ring beam comprising a plurality of hat section members each having a channel section and flanges extending away from said channel section, spliced by tension/compression struts end to end to form a continuous ring around the perimeter of the building said members being mounted horizontally on the exterior wall of said building, with the channel section facing the interior of said building and the flanges being attached to the interior side of the walls above and below the channel section.

2. A ring beam as claimed in claim 1 wherein said channel section forms a seat for the end of a plurality of floor joists of the next level of a perimeter wall of said building.

3. A ring beam as claimed in claim 1 including a at least one vertically positioned stabilizer struts each having first and second ends fastened to said hat section flanges extending above and below said channel section respectively to improve the strength of said hat section in compression prior to concrete placement of said floor.

4. A ring beam as claimed in claim 1, including said ring beam being formed of a plurality of segments of hat section, said members being joined by tension/compression struts bridging and connecting said members.

5. A ring beam as in claim 1, where in said hat section is formed of a base sheet joined to a pair of oppositely positioned Z-sections.

* * * * *